United States Patent [19]

Zofan

[11] Patent Number: 4,664,764

[45] Date of Patent: May 12, 1987

[54] CATHODIC PROTECTION OF STRUCTURES

[75] Inventor: Ely S. Zofan, Columbus, Ohio

[73] Assignee: Floyd Bell Associates, Inc., Columbus, Ohio

[21] Appl. No.: 836,106

[22] Filed: Mar. 4, 1986

[51] Int. Cl.[4] ..... C23F 13/00

[52] U.S. Cl. ..... 204/147; 204/196; 307/95

[58] Field of Search ..... 307/95; 204/147, 196

[56] References Cited

U.S. PATENT DOCUMENTS

| | | | |
|---|---|---|---|
| 3,634,222 | 1/1972 | Stephens | 204/196 |
| 4,080,272 | 3/1978 | Ferry | 204/147 |
| 4,160,171 | 7/1979 | Merrick | 307/95 |
| 4,219,807 | 8/1980 | Speck | 340/664 |
| 4,255,242 | 3/1981 | Freeman | 204/147 |
| 4,383,900 | 5/1983 | Garrett | 204/147 |
| 4,437,957 | 3/1984 | Freeman | 204/147 |
| 4,528,460 | 7/1985 | Staerzl | 307/95 |

*Primary Examiner*—John F. Niebling
*Assistant Examiner*—Ben Hsing
*Attorney, Agent, or Firm*—Mueller and Smith

[57] ABSTRACT

Method, system and apparatus for carrying out the cathodic protection of structures wherein evaluation of true current and true voltages at the counter electrode is carried out by an integration procedure which is timed in conjunction with the cross-over times of the originating a.c. input to the power source. The system also may employ an IR drop free potential measurement of a variety employing a reference electrode and a control which periodically turns off the fluctuating current drive to the working electrode for purposes of carrying out potential measurement from the reference electrode. To improve performance of the system, as well as the true current measuring features, difference networks are used to develop the difference between the signals of one channel, i.e. ground, and the parallel channel, i.e. positive, leading to the working and reference electrodes. With the arrangement, spurious noise phenomena are cancelled. The system also employs a hierarchal control system which operates in conjunction with a soft start procedure functioning to enhance system reliability.

27 Claims, 5 Drawing Figures

CATHODIC PROTECTION OF STRUCTURES

BACKGROUND OF THE INVENTION

Electrochemical reactions that involve the transfer of charge at an electrode-solution interface are examples of a general class of reactions referred to as heterogeneous process, i.e. a chemical change occurs in which two or more reactions take place simultaneously. The kinetics of heterogeneous reactions are normally determined by a sequence of steps involving both transport through a solution phase and transfer of charge at the interface of the solution-electrode. This overall electrochemical reaction involves two step groupings, which are commonly referred to as the activation process and the mass transport process and the rates of the individual processes are somewhat time dependent.

These processes have been the subject of extensive study at the laboratory level for many years and applications of the underlying science have been made to anti-corrosion systems. The latter applications are board in scope, for example involving devices designed for the protection of large structures ranging from public water supply tanks to sports stadiums. Generally, the essential parts of such systems will include a source of direct current and voltage, a "counter electrode" for applying this current into any of a broad range of electrolytes, a "working electrode" which is the structure to be protected and a "reference electrode". If voltage and current conditions developed at the source are correct, an interface or boundary between the working electrode and electrolyte will be developed functioning to restrains the occurrence of chemical reaction which would otherwise result in corrosive activity. Thus, it is necessary to find essentially the precise conditions at this interface or boundary. The technique generally employed for this task is to utilize the noted reference electrode to sense the potential across the interface boundary and also sense the effect of the applied potential at the counter electrode. Generally, the current-voltage relationship at the working electrode is very non-linear. Thus, the amount of current required to develop necessary potential as evidenced at the reference electrode generally is determined for each of the large installations in somewhat experimental fashion, however, such experimental techniques are well known in the art and readily accomplished.

The determination of true potential at the working electrode through the use of a reference electrode, in generally terms, must take account of current flowing through the resistance of the electrolyte to that electrode, which develops an "IR drop" considered in a broad sense to exist between the working electrode and the reference electrode. That "IR drop", in effect, is added to the true potential and to a degree, serves to mask it. Thus, to find the true potential and accurately control the corrosion retarding system, a technique for canceling out this IR drop effect is required. A more refined analysis of the "IR drop" considers that a somewhat varying current density, j, evolves intermediate the counter electrode and the working electrode. The electrolyte, i.e. often concrete, will exhibit a complex, varying resistivity, $\rho$. Compensation therefore must accommodate for the evolved vector quantity $E=j\rho$. The potential is the (line integral) $v=\int j\rho \cdot ds$; s being total path between the electrodes. Note that j is proportional to the impressed current, i, such that when current, i, is zero, j is zero and the noted integral value becomes zero, true potential being that voltage remaining when the integral goes to zero.

For the most part, corrosion control practitioners have employed a technique wherein the current from the counter electrode is momentarily interrupted such that it drops to zero and the corresponding masking IR drop is reduced to essentially a zero value. True potential then is measured quickly and stored. Such period of current shut-down must be limtied to a practical extent or the corrosion process will recommence upon any such removal of protective potential. The general practice has been to carry out this true potential evaluation about once each second. typically, a feedback form of control is employed in conjunction with a preset reference for purposes of maintaining predetermined true potential. While these techniques are relatively widely utilized, a need has arisen in the industry for higher levels of accuracy in the control systems as well as a broader rang of measurement parameters, i.e. current and voltages developed by the power supply for application to the counter electrode. Particularly, it has become important to provide very accurate measurements of the current supplied by the systems in recognition of the mass transport process law wherein the amount of reaction is proportional to charge transfer or average current multipled by time. Because for typical installations that current is fluctuating evaluations thereof have not been accurate. Further, the practioners have expressed a desire for a control over the voltage applied to the counter electrode. In effect, a greater degree of flexibility is required such that, under unusual circumstances which may occur where voltage excursions can cause extensive damage, i.e. internally coated water tanks and other installations, some form of over-voltage protection may be made available and a form of overriding control based upon current values is desirable.

SUMMARY

The present invention is addressed to a method, system, and apparatus wherein true values of the fluctuating direct current supplied to the counter electrode of an anti-corrosion system may be developed, as well as true values of correspondingly supplied voltages. These true values are achieved by apparatus and procedures wherein each pulse or cyclically determined fluctuating signal is integrated. Thus, the inaccuracies attendant with conventional averaging procedures and the like are avoided and a desirably high degree of current and voltage measurement and control accuracy is achieved. Because the integration is carried out in close conjunction with the cyclic cross-over times of the underlying a.c. power input to the system, slippage or loss of signal which otherwise would adversely affect accuracy is avoided and a high degree of reliability is recognized.

By comparing these integrated voltage signals and integrated current signals with respect to voltage control and current control signals derived by set inputs selected by the user, voltage correction and current correction signals may be developed for use in a feedback form of power supply control. Through appropriate set input adjustment, the user may elect that electrical parameter, such as voltage or current, which is to predominate in the overall control scheme. However, that parameter not so elected by virtue of a higher level set point, will still provide protection against excursions in the event that the predominating control parameter networks fail for some reason or another. For example, where the voltage parameter is lower in the control hierarchy, then it will provide an over voltage protection for the system. Conversely, where the current parameter is of lesser predominance in the control hierarchy, then an over current protection will be provided.

The system also operates with a third control wherein conventional IR drop free measurements are carried out employing a reference electrode. With this arrangement, the reference potential and reference ground values are monitored and the outputs thereof are directed to a difference network which functions to cancel any spurious noise phenomena which may occur in the lines extending to the electrodes. These lines may be 600 feet or more in length and are prone to respond to various environmental noise generating phenomena. In conventional fashion, the power supply is disabled for an interval wherein the IR free drop potential may be sampled and compared with a set or selected value potential control signal for purposes of developing a potential correction signal. This signal then may be employed in a feedback control arrangement which may include the noted hierarchal selection of parameter.

Improvement in the system and apparatus also is provided through the utilization of a soft start technique.

Another feature of the invention is to provide a system for protecting a structure associated with an electrolyte from corrosive ion transfer, having a power supply connectable with a cyclic power input and a controllable output of fluctuating direct current and given voltage value for application to a counter electrode within the electrolyte. The system includes a current monitoring arrangement connectable with the power supply and having output signals responsive to the fluctuating direct current. A current integrator receives and integrates the output signals to provide integrated current signals and this integrator is resettable upon actuation. A first storage is provided for receiving the integrated signals. The user may selectively adjust a current set arrangement to provide a selected value current control signal which then is compared by a current value comparator with the integrated current signals received at the first storage and derives a current correction signal. A voltage monitor is connectable with the power supply and has voltage signals responsive to the given voltage value of that supply. A voltage integrator receives the voltage signals to provide integrated voltage signals and is resettable upon actuation. A second storage arrangement is provided to receive the integrated signals, while a voltage set arrangement is provided which is adjustable by the user to provide a selected value voltage control signal which is compared by a voltage value comparator with the integrated voltage signals to derive a voltage correction signal. Switching is provided for actuating the current integrator and the voltage integrator in timed correspondence with the cyclic power input and a control is provided which is responsive to the current correction signal and the voltage correction signal for controlling the power supply in accordance with the one correction signal of highest value.

Another feature of the invention is to provide a system for protecting a structure associated with an electrolyte from corrosive ion transfer, the system having a reference electrode and reference ground, a power supply connectable with cyclic power input and a controllable output of fluctuating direction current and given voltage value for application to a counter electrode within the electrolyte. The system includes a reference monitor having a first channel connectable with the reference electrode and a second channel connectable with the reference ground for respectively receiving reference and ground signals. A difference network is provided which is responsive to the reference and ground signals thus derived for developing a reference voltage signal at an output corresponding with the difference therebetween so as to effect cancellation of spurious noise phenomena. A potential set arrangement is provided which is adjustable to develop a selected value potential control signal which is compared by a potential value comparator with the reference voltage signal for deriving a potential correction signal. A first switching arrangement is coupled intermediate the difference network output and the potential value comparator which is responsive to a potential sample signal for effecting transfer of the reference voltage signal to the potential value comparator and a control is responsive to the potential correction signal for controlling the power supply to derive the fluctuating direct current in accordance with the value of the correction signal. The control further is responsive in the presence of a disable condition to terminate the derivation of the fluctuating direct current. A timing arrangement is provided for periodically deriving the disable condition for a predetermined interval selected to derive an effective reference voltage signal and for deriving the potential sample signal for a predetermined sample interval during the disable condition.

The invention also features a method for controlling the application from a power supply output of cyclic but fluctuating pulses of direct current at a counter electrode having a positive leads extending thereto and a lead extending to a structure immersed in an electrolyte, for retarding corrosion of the structure. This method includes the step of sensing the direct current through first and second signal carrying channels extending from opposite sides of a current monitor associated with one lead. Spurious noise phenomena are cancelled within the first and second channels by electrically deriving the difference between the signals therein to derive output signals. These output signals are integrated in timed correspondence with each cycle appearance of the power supply output pulses to provide integrated current signals. Values of the integrated current signals are compared with a first predetermined set value to derive current correction signals. The voltage of the power supply output is sensed to derive voltage signals and these voltage signals are integrated in timed correspondence with each cyclic appearance of the power supply output pulses to provide integrated voltage signals. Values of the integrated voltage signals are compared with a second predetermined set value to derive voltage correction signals and the current level of the power supply output is controlled in correspondence with the correction signal of largest value.

Other objects and features of the invention will, in part, be obvious and will, in part, appear hereinafter.

The invention, accordingly, comprises the apparatus, system, and method possessing the construction, combination of elements, arrangement of parts, and steps which are exemplified in the following detailed disclosure. For a fuller understanding of the nature and objects of the invention, reference should be had to the following detailed description taken in connection with the accompanying drawings.

DETAILED DESCRIPTION

Figure 1:
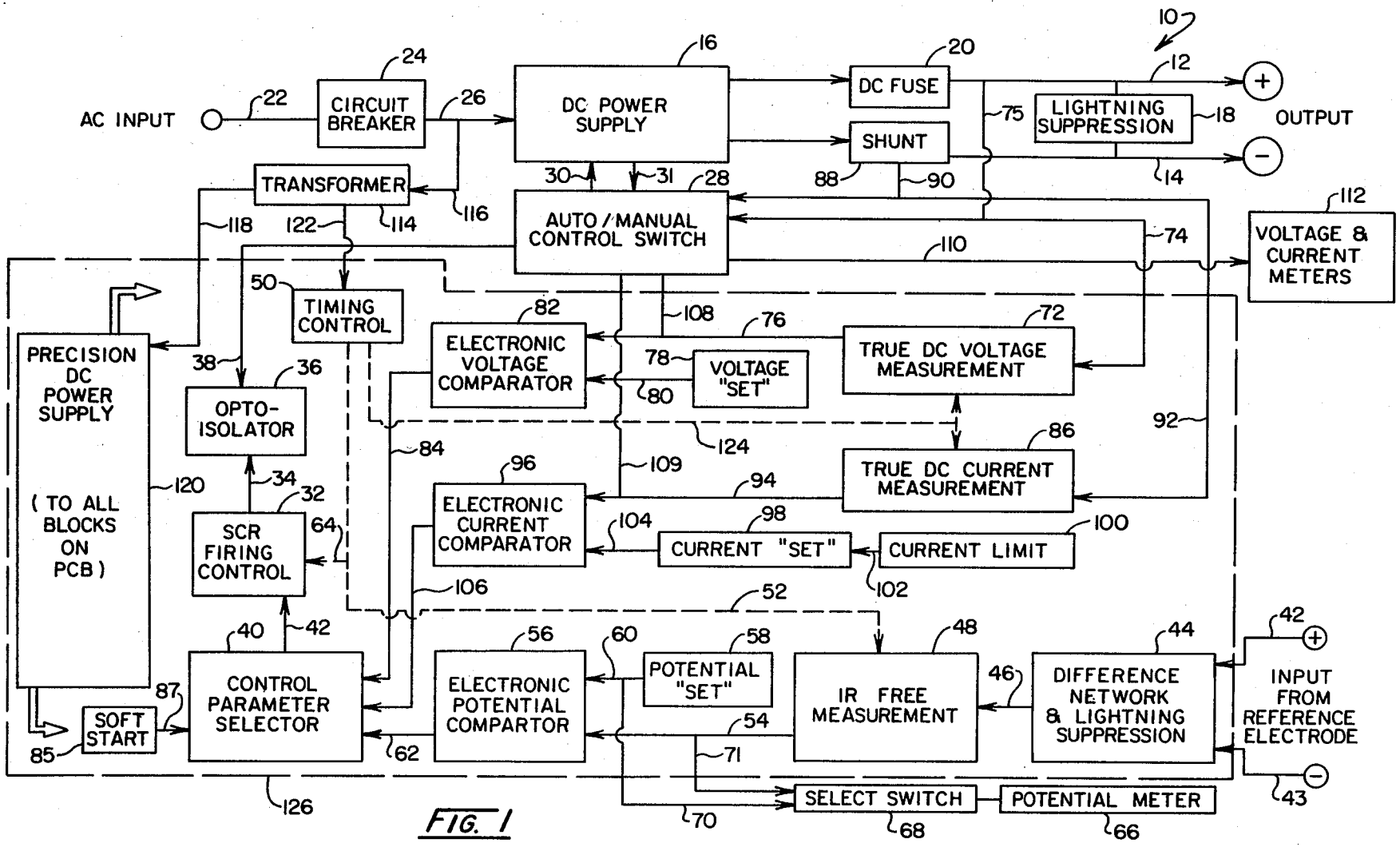
FIG. 1 is a block diagrammatic presentation of the apparatus and system of the invention.

The control or logic approach of the instant invention is revealed in block diagrammatic form in FIG. 1. Looking to that figure, the logic and control circuit is represented generally at 10 as including a positive output line 12 and negative output line 14 which are connecable to a counter electrode (not shown). Line 14 functions somewhat as a virtual ground functioning in conventional fashion to avoid working electrode passage through contacts and attendant contact resistance. Lines 12 and 14 carry cyclicly derived but fluctuating pulses of direct current at relatively high amperage which are developed from a power supply represented at block 16. The power supply 16, in typical fashion, develops the noted cyclical d.c. pulses by appropriately gating a pair of silicon controlled rectifiers (SCRs). Inasmuch as lines 12 and 14 may be of considerable length, conventional lightning suppression components are provided, as represented at block 18 and circuit protection is provided by a d.c. fuse represented at block 20. Component 18 serves a clamping function and may, for example, be provided as a Selenium Surge Suppressor, Part No. C697B, marketed by Cougar Electronics Corp., Brooklyn, N.Y., U.S.A. a.c. utility power input is provided to the power supply 16 as represented at line 22 and this cyclic input, i.e. 60 Hz, is directed through a circuit breaker represented at block 24 and thence via line 26 to the supply 16. Supply 16 will include a step-down transformer in addition to the noted SCRs and is controlled in switching fashion both automatically and manually as represented in conjunction with block 28. The interactive association of the control 28 with the power supply at 16 is represented by lines 30 and 31, while switching drive thereto is developed from an SCR firing control network represented at block 32, the output of which is represented at line 34 as being directed to an opto-isolator represented at block 36 and thence to the switching function 28 as represented at line 38. The SCR firing control function 32 is, in turn, in part controlled by a parameter selection function represented at block 40 and line 42. This parameter selection permits the operator to carry out not only IR drop free measurement but also to control based upon parameters of true d.c. current or true d.c. voltage as measured from respective output lines 14 and 12. Further, these parameter controls may be employed by the selector function 40 to evoke a voltage and current override protection for these systems which, for the most part, are situate in remote locales where immediate attendance is not always available.

Connection to the reference electrode, including a reference (virtual) ground connection is provided from along lines 42 and 43. Because the lines 42 and 43 may be of considerable length, for example up to about 600 feet, a.c. noise often is developed. In accordance with the instant invention, this spurious noise is cancelled through the use of a difference network or stage which is represented at block 44. This difference network, in effect, subtractively sums the signals within the two channels corresponding with lines 42 and 43. As labeled in the block, conventional lightning suppression techniques also are employed with these lines. The reference voltage signal output of network 44 is directed as represented at line 46 to an IR free measurement network represented at block 48. This stage 48 functions under a timing control represented at block 50 as indicated by dashed line 52 to measure the potential at the reference electrode during short intervals wherein current drive to the counter electrode is turned off. The thus-measured IR free potential or reference voltage signal is directed via line 54 to one input of a comparator stage represented at bloc 56. The opposite input to stage 56 is provided from a reference potential or potential control signal which is "set" by the user as represented at block 58 and line 60. A form of correction or control signal then is outputted from comparator 56 to the parameter selection network 40 as represented at line 62. It may be observed that the timing control function shown at block 50 also provides for turning off the system to permit IR free measurement by an input represented at line 64 leading to the SCR firing control network represented at block 32. A visual readout, for example a potential meter is provided as represented at block 66. This meter provides readouts of both the potential which is set by the user as represented at block 58 and alternately the IR-free measurement as presented at line 54 through user actuation of a select switch represented at block 68. Coupling to the select switch from line 60 is provided by line 70, while the input from line 54 to the switch function 68 is shown at line 71. Of course, multiple meters and other monitoring systems may also be employed depending upon the desires of the designer.

Circuit 10 also includes a network which carries out a true d.c. voltage mesurement which is represented generally at block 72. Because the SCRs employed in deriving the fluctuating d.c. output of the system are fired at different angles to achieve current output control, general voltage averaging will not produce a desirably accurate measurement of that parameter. Network 72 will be seen to carry out an accurate integration and related treatment to achieve the desired true voltage developed at line 12. In the latter regard, that voltage is monitored via lines 74 and 75 for providing a true voltage measurement or integrated voltage signals at output line 76. The user may establish a set voltage or voltage control signal for comparison with the measure voltage at line 76 as represented by block 78. Block 78 is shown providing a voltage set input or control signal via line 80 to a voltage comparator stage represented at block 82. The opposite input to stage 82 is provided as the integrated voltage signal at line 76 and a resultant control or correction signal is developed for presentation along line 84 to the parameter selection control described earlier at block 40.

In similar fashion, the circuit 10 provides for a measurement of true d.c. current as represented by block 86. As in the case of the true d.c. voltage measurement, the true d.c. current measurement is carried out by an integrating approach, the current being monitored by a shunt resistor within line 14 as represented by block 88. Block 88 has a two-channel (positive and negative) output at line 90 which, in turn, is shown directed via line 92 to the input of block 86. Integrated current signals are provided at line 94 which is directed to one side of a comparator stage represented at block 96. The opposite input the comparator stage at block 96 is provided by current control signals developed by a current set input represented at block 98. Adjustment by the operator of the desired current level for control, i.e. achieved with the function at block 98. Additionally, however, a factory set maximum current limit is provided as presented at block 100 which sets a maximum voltage, i.e. current range for the adjustment which may be made by the operator in conjunction with the function at block 98. An association of this current limiting input and the current set function is represented at line 102. Current control signals of the set current function are provided at line 104 which is directed to the opposite side of the comparator function represented at block 96. A resultant current limiting and control output or current correction signal then is provided at line 106 which is directed to the parameter selector function represented at block 40.

A metering readout is provided with respect to both the true d.c. voltage measurement and true d.c. current measurement as represented by respective lines 108 and 109. These lines are shown being directed to the switching function at block 28, thence via line 110 to the voltage and current meter readout function as represented at block 112.

Power to the logic components of circuit 10 is derived from a signal transformer represented at block 114 which is coupled with the input power at line 26 via line 116. This transformer carriers a.c. frequency information for synchronization purposes and provides input to a precision d.c. power supply as represented by line 118 and block 120 as well as via line 122 to timing control 50. The timing control 50, operating the frequency information of with the a.c. input at line 22, provides the turn off function as above described via line 52 and also serves to develop the highly accurate actuating timing for controling the true d.c. voltage measurement and true d.c. current measurement as represented by respective blocks 72 and 86. This control input is represented by dashed line 124.

It may be observed that the parameter selection control function represented at block 40 receives three input parameter signals emanating from lines 84, 106 and 62. The selection function permits the operator to select that parameter upon which control is to be based and, further, to develop limiting values for current and voltage. Thus, in the event of a profound electrolyte change (water level in a tank) the parameter selection may be called upon to impose a current limitation or voltage limitation as an override control. While circuits as provided by th instant invention require starting up relatively infrequently, it is desirable that they be protected from phenomena such as current surges and the like often encountered during such procedures. To accommodate for this condition, a "soft start" network is provided as represented by block 85 and line 87. This network serves to restrict the duty cycle effected at SCR control 32 during a select interval at start-up.

Figure 2A:
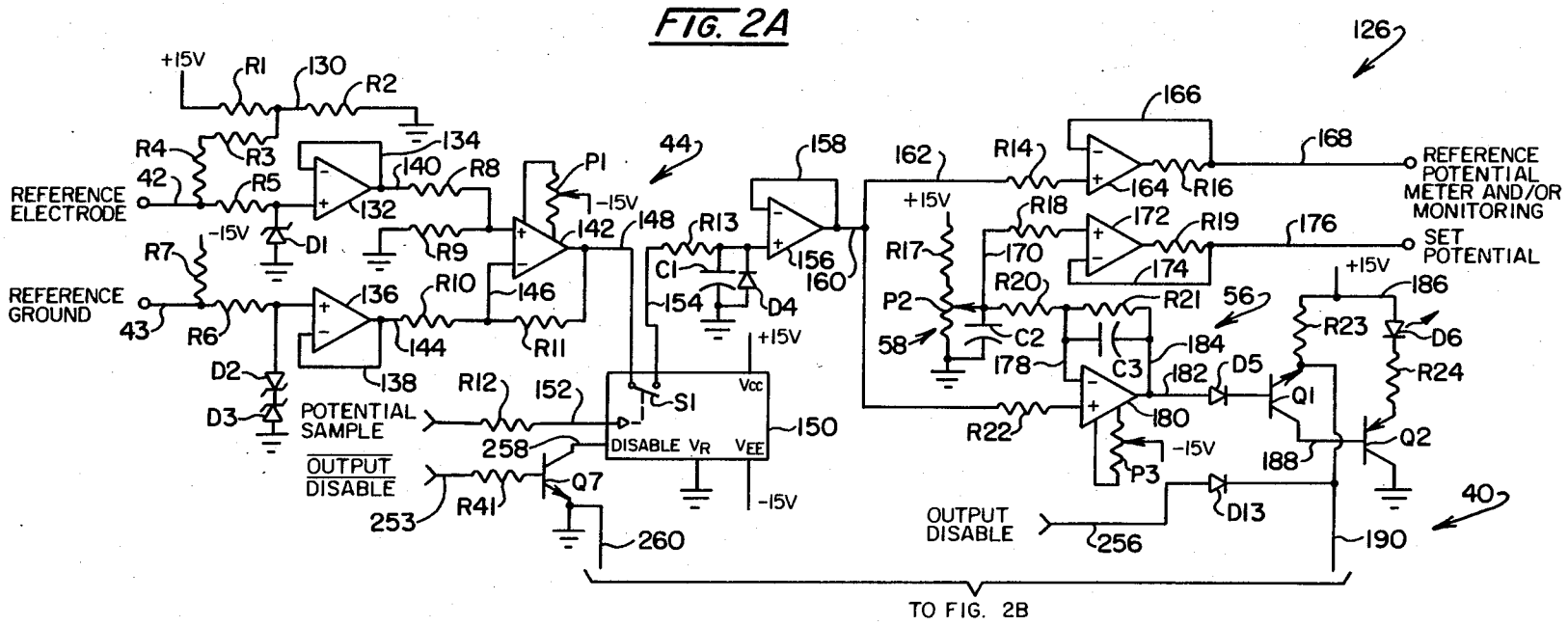
FIGS. 2A–2C, taken together in the orientation as labelled thereon, provide an electrical schematic diagram of the logic circuit employed by the apparatus and system of the invention.
Figure 2B:
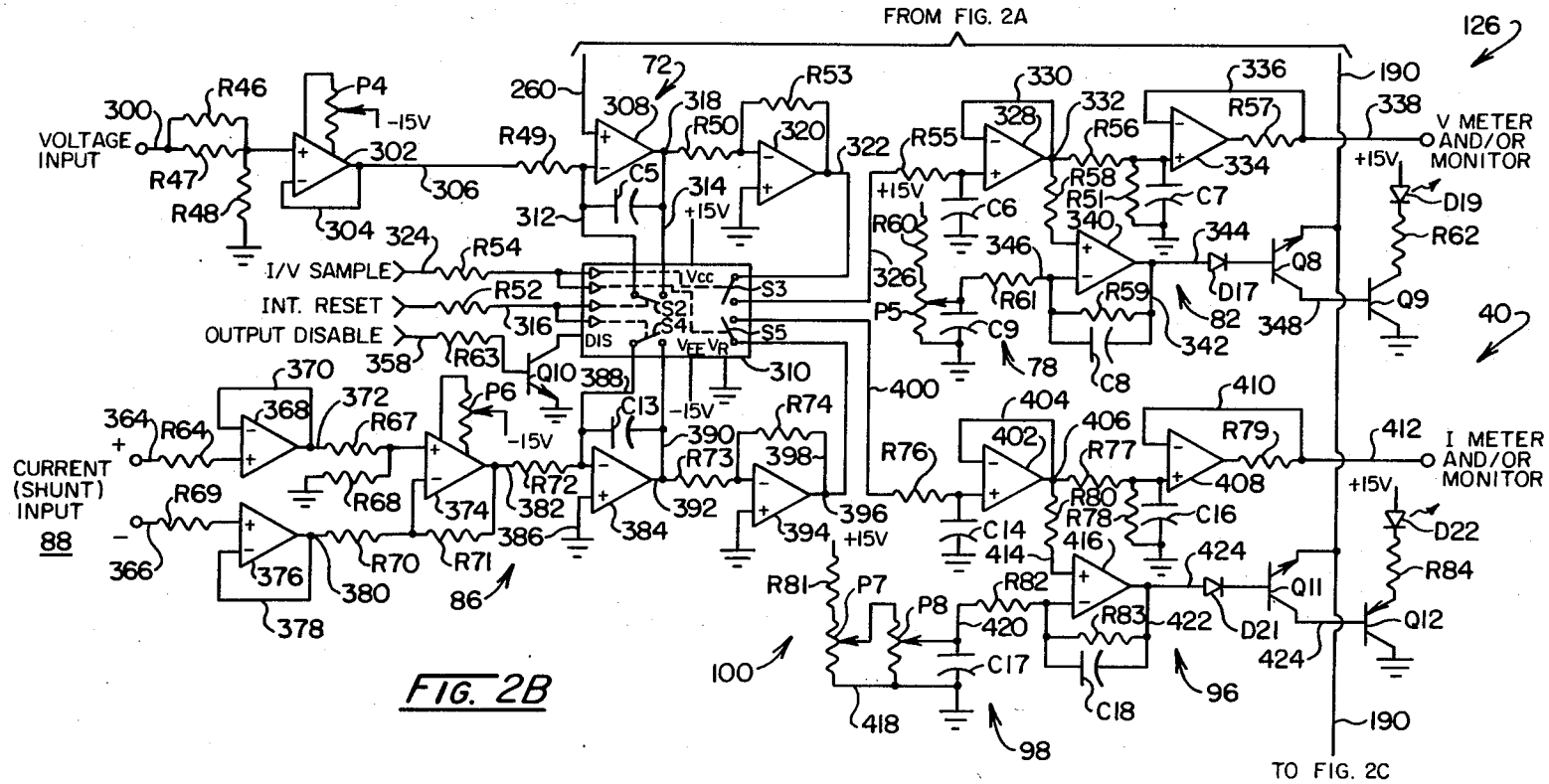
Figure 2C:
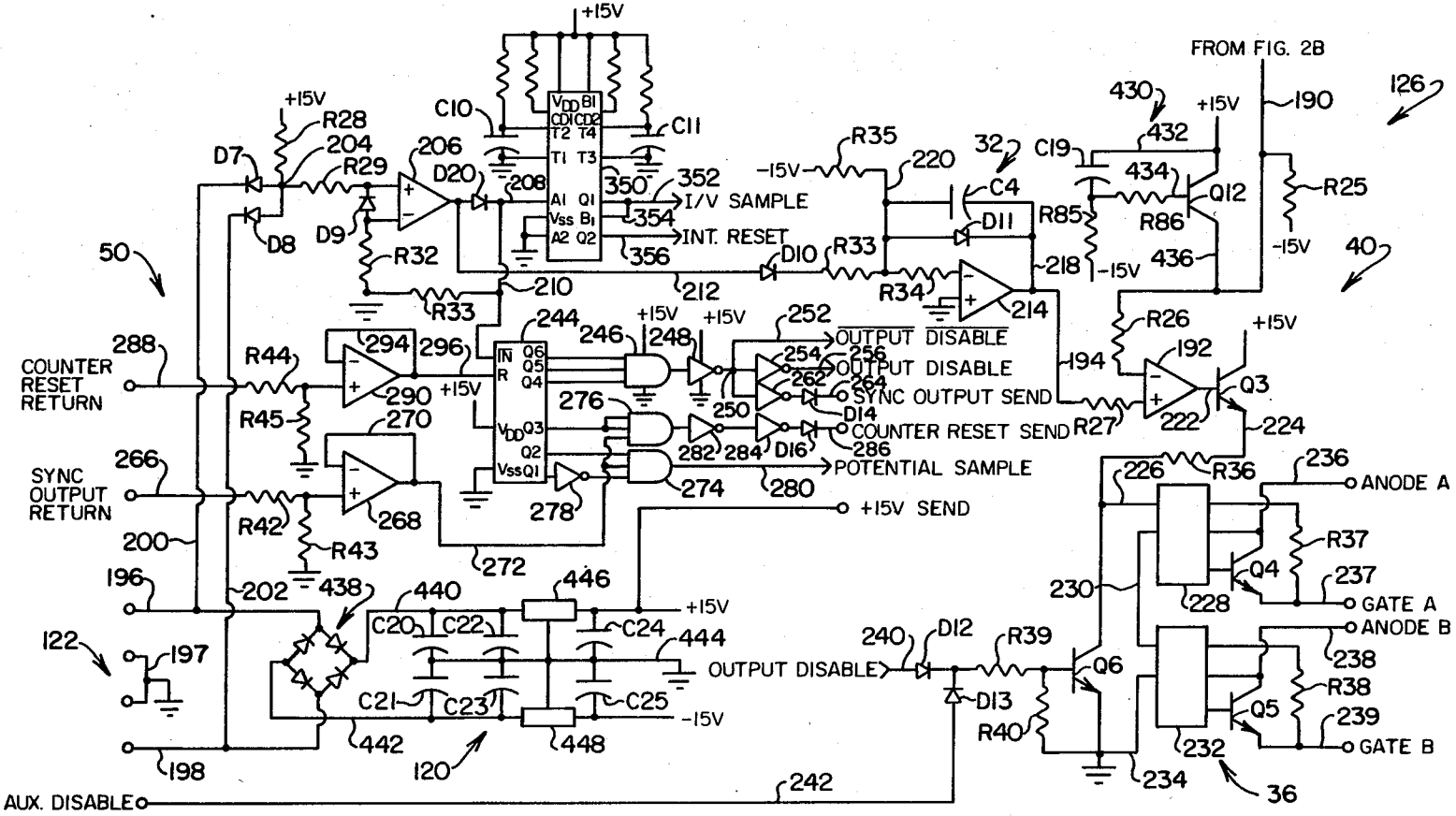

Referring to FIGS. 2A–2C, a detailed representation of the logic components of circuit 10 falling within the dashed boundary 126 in FIG. 1 is provided. FIGS. 2A–2C should be considered as arranged according to the labeling thereon in conjunction with the discourse to follow.

Looking to FIG. 2A, the difference network and lightning suppression portion 44 of the IR free measurement circuit is again revealed in conjunction with the input channel line 42 from the reference electrode and reference ground input channel 43. Line 42 is seen coupled to a voltage divider network comprised of resistors R1 and R2 coupled between +15 v supply and ground and commonly joined at line 130. Line 130, in turn, is coupled through very high resistance value (44 megohm total), resistors R3 and R4 to line 42. The voltage divider and resistor network thus described provide a select voltage input (at least at set potential) to the IR free measurement circuitry so as to, in effect, disable the SCR current drive at such time as the line 42 leading to the reference electrode is lost due, for instance, to cutting or some similar accident. It may be recalled that these lines may be, for example, 600 feet in length. Line 42 is coupled to the positive input of a voltage follower or high impedance buffer formed of operational amplifier 132 and a feedback path provided as line 134 coupled to the inverting input of the amplifier. The circuitry further is protected at its input by a current limiting resistor R5 coupled to line 42 as well as a Zener diode D1 which limits any spikes or excusions to about 15 volts. Zener diode serves a clamping function which provides, for example, protection against lightning strikes and the like. In similar fashion, line 43, providing a reference ground, is directed through current limiting resistor R6 to the positive input of a voltag follower or high impedance buffer formed of operational amplifier 136 having a feedback line 138. Line 43 is coupled through resistor R7 to −15 v supply to provide a desired disabling signal into the system in the event of a loss of line 43 in the same manner as treatment of line 42. Lightning and spurious voltage spike protection is provided by current limiting resistor R6, as well as oppositely disposed Zener diodes D2 and D3 coupled between line 43 and ground.

The output of buffer stage 132 at line 140 is directed to a voltage divider network comprised of resistors R8 and R9 and extends, in turn, to one input of the operational amplifier 142 of a difference network. In similar fashion, the output of buffer stage operational amplifier 136 at line 144 is directed through resistor R10 and line 146 to the inverting input of operational amplifier 142. Incorporating a feedback including resistor R11 extending from its output line 148, amplifier 142 then serves to perform a subtracting function. Thus, the reference electrode signals are subtracted to effect a cancellation of spurious noise phenomena which will be carried simultaneously by lines 42 and 43. The zero offset of amplifier 142 and those amplifiers following it, may be adjusted by a potentiometer P1.

Output line 148 is shown directed through a solid-state switch incorporating contacts identified as S1 and represented by block 150. Such switching may be provided, for example, as type LF13331. Switch S1 is actuated to a closed orientation by the assertion of a signal identified as "potential sample" asserted through resistor R12 from line 152. The opposite side of switch S1 is coupled via line 154 and resistor R13 to a form of sample and hold or storage network including current limiting resistor R13 and storage capacitor C1. Thus, upon the closure of switch S1 the improved signal representing reference electrode voltage is stored within capacitor C1. Diode D4 coupled across capacitor C1 serves to protect it from negative excursions and the like.

The sampled value of voltage which is retained at capacitor C1 is directed through the positive input of another voltage follower or high impedance buffer which is provided as an operational amplifier 156 having a feedback line 158 extending from its output at line 160 to its inverting input. Output line 160 is coupled through line 162 and resistor R14 to the input of a buffer formed of operational amplifier 164 having a current limiting resistor R16 at its output and feedback path 166. The output of the buffer stage at line 168 is used as a reference potential output for a meter readout and/or a monitoring system.

The desired potential of the IR free measurement and control circuit is set by the user by adjusting a potentiometer P2. Potentiometer P2 forms a voltage divider in conjunction with resistor R17 extending, in turn, between +15 v supply and ground. The wiper arm of potentiometer P2 is coupled through line 170 and input resistor R18 to a buffer comprised of operational amplifier 172, current limiting resistor R19 and feedback line 174. A capacitor C2 positioned between the earlier noted ground and line 170 and the wiper arm of potentiometer P2 serves a filtering function for set potential. The output of amplifier 172 at line 176 is directed to a meter and/or monitoring function such that the operator may observe the potential being set while adjusting the wiper arm of potentiometer P2. The latter wiper arm also is coupled through resistor R20 and line 178 to one input of a comparator stage comprised of a very high gain operational amplifier 180 having a feedback path formed by line 184 extending from output line 182 and incorporating a resistor R21. A capacitor C3 extends about resistor R21 for filtering purposes. One input of amplifier 180 receives the set potential or potential control signal provided by the user via line 178 and resistor R20, while the opposite input of the amplifier is provided as the measured reference potential, i.e. the reference voltage signal, which is asserted through input resistor R22. Offset adjustment of the amplifier 180 is provided by a potentiometer P3, the wiper arm of which is coupled to −15 v supply. In operating as a comparator, where the set potential as provided by the adjustment of potentiometer P2 is below the IR free measurement asserted through resistor R22, then the potential correction signal output at line 182 will be positive and, in the opposite situation, will tend toward a negative output. This output at line 182 is directed through a protective diode D5 to the base of an NPN transistor Q1. The emitter of transistor Q1 is coupled with a divider resistor R23 which, in turn, is coupled through line 188 to +15 v supply and to light emitting diode (led) D6. The cathode of diode D6 is coupled through resistor R25 to the emitter of a PNP transistor Q2, the collector of which is coupled to ground. The collector of transistor Q1 is coupled through line 188 to the base of transistor Q2. Thus, when transistor Q1 is forwardly biased, and appropriate conditions obtain, then transistor Q2 is drawn into conduction and diode D6 is illuminated, representing the operation of the system under the control of the IR free measurement circuit. The combination of transistor Q1 with transistor Q2 achieves a form of Darlington effect which is helpful in view of the low current involved in the controlling network.

Divider resistor R23 is operatively associated through line 190 with another divider resistor R25 which, in turn, is coupled to −15 v and is shown in FIG. 2C. These resistors form a portion of the parameter selection control aspect described in conjunction with block 40 in FIG. 1 and serve to establish a fundamental voltage, for example, of about −1 v or −2 v which is acted upon or affected by the conductive condition of the output transistors within each of the control modes, one such output transistor being transistor Q1. The nature of correction signal adjustment of voltage on line 190 will determine the duty cycle of performance of the SCRs of the d.c. power supply described in conjunction with block 16 in FIG. 1. This control, as described in FIG. 1 in conjunction with block 32, also achieves a prioritization or hierarchy scheduling of each mode of control. For example, an IR free measurement form of control employing the circuit of FIG. 2A will dominate by the forward biasing of transistor Q1 and control over voltage values at line 190. This is achieved by user adjustment of potentiometer P2. On the other hand, the user will be seen to have the opportunity to adjust other parameter modes to selected priority in the hierarch form of control. The voltage value developed by the interaction of transistor Q1 with line 190 is utilized in conjunction with a comparator and ramp generator to effect control over the duty cycle of the SCRs of the d.c. power supply 16.

Looking to FIG. 2C, control line 190 is seen to extend through resistor R26 to the negative input of a comparator 192. The opposite input to comparator 192 is a ramp signal asserted through line 194 and resistor R27. This ramp signal is associated with the timing function of the control circuit which finds its genesis in the small signal transformer 114 described in connection with FIG. 1. Transformer 114 is a center tap device the secondary outputs of which were described in FIG. 1 at 122 are shown in FIG. 2C at lines 196–198. It may be recalled that the transformer 114 is coupled to a conventional 60 Hz a.c. input and thus, the cyclic output at lines 196 and 198, at directed through respective lines 200 and 202, will be at a frequency of 60 Hz. Lines 200 and 202 extend through respective diodes D7 and D8 to junction 204 which is coupled through resistor R28 to +15 v. Because of the center tap nature of the output of transformer 114 as at lines 196–198, the polarity of lines 200 and 202 will alternate at the noted 60 Hz rate in a positive and negative fashion. Accordingly, diodes D7 and D8 are turned on in the event of a negative level at an associated line 200 or 202. Junction 204 is seen to be coupled through resistor R29 to the positive input of an operational amplifier 206 which is functioning as a comparator, while the negative terminal of that amplifier is coupled through a diode D9 to its positive input. The anode of diode D9 further is coupled through resistor R32 to ground, while the output of the amplifier 206 at line 208 is coupled via line 210 and resistor R33 to ground. With the arrangement shown, a positive pulse is generated at line 208 on the occurence of each of the crossover excursions of the 120 Hz signal present at lines 200 and 202. Line 208 additionally is coupled to line 212 which extends through a diode D10 and resistors R33 and R34 to the negative input of an operational amplifier 214. The positive input to the amplifier 214 is coupled to ground, and the output thereof at earlier-described line 194 is coupled in a feedback path including line 218 and capacitor C4 to −15 v supply through line 220 and resistor R35. Thusly configured, an integrator is formed with device 214 having a time constant depending upon the values of components C4, R33 and R34. This time constant preferably provides a time-out function to generate the ramp required at line 194. Upon each cyclic cross-over, diode D10 is forward biased to cause a resetting of the integrating function for the ramp generator and this is carried out by the rapid discharge (ramping down) of capacitor C4 through diode D10 and rsistor R33. Diode D11 serves a protective function for capacitor C4. Thus, for each half cycle, a ramp is applied to the comparator 192 through line 194 and resistor R27, while a control level is imposed on the opposite side of the comparator 192 through resistor 26. At such time as the value from line 190 and resistor R26 is above the voltage asserted from the ramp and resistor R27, then the output of comparator 192 at line 222 is negative. At cross-over with the ramp, i.e. under conditions wherein the voltage value through resistor R27 essentially is above the voltage value through resistor R26, then the output at line 222 reverts to a high value to forward bias the base emitter junction of NPN transistor Q3. The collector transistor Q3 is coupled to +15 v supply, while the emitter thereof is coupled through line 224, resistor R36, and line 226 to the input of an optocoupler 228. Coupler 228, in turn, is connected in cascade fashion via line 230 to the input of a second optocoupler 232. In effect, line 226 is coupled to the anode of an optodiode within coupler 228, while line 230 extends from the cathode thereof to the corresponding anode of a similar optodiode in coupler 232. The cathode of the latter optodiode is coupled by line 234 to ground. Couplers 228 and 232 may, for example, be provided at type H11D1 and, when so interconnected, operate such that when the SCR driven by coupler 228 is gated on, the corresponding SCR driven from coupler 232 is commutated off. The internal phototransistors of each of the optocouplers 228 and 232 are coupled in Darlington support fashion with respective NPN transistors Q4 and Q5. It may be observed that the collector of transistors Q4 is coupled to lead 236 labelled "anode A" and the emitter thereof is coupled to lead 237 labeled "gate A". In similar fashion, the collector of transistor Q5 is coupled to line 238 labelled "anode B", while the emitter thereof is coupled to line 239 labelled "gate B" and providing control over a second SCR drive of the power supply 16. Resistors R37 and R38 are provided to avoid false turn on of the transistors Q4 and Q5.

With the arrangement thus disclosed, the two SCRs of the d.c. power supply 16 are alternately activated depending upon the output of transistor Q3, which may turn on later in any given half cycle to reduce the amount of pulse categorized current developed. To make an IR free measurement, optocouplers 228 and 232 are disabled and this is accomplished by the turning on of NPN transistor Q6 which is coupled to selectively connect line 224 to ground and shunt the optocouplers. The transistor Q6 is turned on by a logic high signal applied at line 240 through diode D12 and base resistor R39. An avoidance of noise induced turn on of transistors Q6 is provided by resistor R40 coupled between the base thereof and ground. An auxiliary disable feature also is provided via line 242 and diode D13 which can be activated manually or employed in conjunction with safety turn-off features as may be activated by overheating conditions or the like. A logic high signal applied to line 242 functions to turn on transistor Q6 and disable the output of the system.

IR free measurement with attendant counter electrode disablement is carried out with the instant system with a periodicity basis of once every half second. The interval of disablement condition is 33.33 milliseconds, thus the SCRs and counter electrode are driven for a corresponding interval of 466 milliseconds. This timing is developed from timing control 50 and, in particular, the 120 Hz (8.33 milliseconds) pulses available at line 210 are seen directed to the input terminal of a counter 244 which may, for example, by provided as a type CD4040. The Q4–Q6 terminal outputs of counter 244 are coupled to a three input AND gate 246, the output of which is inverted at inverter 248 which, in turn, provides an output at line 250 extending to line 252 to provide an OUTPUT DISABLE. The signal at line 250 again is inverted at inverter 254 to provide an "OUTPUT DISABLE" signal at line 256. By virtue of its input connection with counter 244, gate 246 provides a logic high output which is inverted to a logic low by inverter 248 at line 250 each 466 milliseconds of each one-half second interval of operation. This output disable condition signal is directed to line 240 for purposes of disabling the optocounters 228 and 232. Looking momentarily to FIG. 2A, it may be observed that the OUTPUT DISABLE at line 252 is, in turn, presented through line 253 and a base resistor R41 to the base of NPN transistor Q7. The collector of transistor Q7 is coupled via line 258 to the disable terminal of solid-state switch 150, while the emitter thereof is coupled to ground and line 260. Thus, upon the occurrence of the disable signal condition, assurance is made that switch 150 will not be operational. Simultaneously, the output disable signal at line 256 is directed through diode D13 to line 190 to provide an override of the signal thereon effectively disabling the SCR drive during the sampling period. This provides a "failsafe" form of performance for the system.

Returning to FIG. 2C, the signal at line 250 employed for the output disable forms of control, additionally is inverted by inverter 262 and the inverted signal is directed through a diode D14 to be provided as a "SYNC OUTPUT SEND" signal at line 264. The "SYNC OUTPUT SEND" signal is sent "offboard" such that other circuits working in complement with the same working electrode may be synchronized with the instant circuit. For example, in many installations several such circuits will be in operation. Accordingly, upon being directed to any complementary systems, the "SYNC OUTPUT SEND" signal returns as a "SYNC OUTPUT RETURN" signal at line 266. A returning signal is directed through high voltage protection resistor R42 and protective resistor R43 to the positive input of a buffer 268 formed of an operational amplifier in conjunction with feedback line 270. Line 272, the output of buffer 268 is coupled to one input of each of two AND gates 274 and 276. The inputs of three input AND gate 274 also are coupled to receive the output of terminal Q1 of counter 244 as inverted by inverter 278 and the output of the Q2 terminal of the counter. As a consequence, the timed output of the gate at line 280 is provided as a "POTENTIAL SAMPLE" signal which is initiated 16.66 milliseconds after the occurrence of the "OUTPUT DISABLE" signal. The gap in time so provided permits the system to "settle down" prior to making an IR free measurement. However, the "POTENTIAL SAMPLE" signal at line 280 then commences and occurs for an interval of 8.33 milliseconds. Looking momentarily to FIG. 2A, it may be observed that the signal is passed through resistor R12 and line 152 to close switch S1 and permit the sample and hold or storage function of capacitor C1 to occur. This "POTENTIAL SAMPLE" signal ends following the noted 8.33 milliseconds and, following an additional 8.33 miliseconds, the logic presented at the input of three input AND gate 276 provides for the ANDing of the signal at line 272 with terminal Q3 of counter 244 to provide a "COUNTER RESET SEND" signal. This latter signal is derived from the output of gate 276 which is inverted at inverter 282 and 284 and directed through diode D16 to line 286. The signal at line 286 also is taken offboard for synchronization with complementary systems and returns at line 288, whereupon it is directed through resistor R44 to the input of buffer stage 290. A resistor R45 protects the input of the buffer. Buffer 209 is formed of an operational amplifier and feedback path at line 294 extending from its output line 296 to its inverting input in conventional fashion. Line 296 is directed to the reset terminal of counter 244 and the occurernce of the "COUNTER RESET RETURN" signal at line 288 provides for the resetting of the counter at a period of 500 milliseconds from initial commencement of counting. A next half second interval then occurs wherein the d.c. power supply 16 is activated for 466 milliseconds, whereupon the system is disabled for measurement purposes for a period of 33.33 milliseconds. In the latter interval, a setting down interval of 16.66 milliseconds occurs, following which sampling is carried out by closure of switch S1 for an interval of 8.33 milliseconds. Switch S1 then is opened and a period of 8.33 milliseconds occurs before a synchronizing reset signal is generated to reset counter 244.

Referring to FIG. 2B, the parallel true d.c. voltage measurement and true d.c. current measurement circuits described in conjunction with blocks 72 and 86 in FIG. 1 are revealed at an enhanced level of detail. These two circuits operate in parallel with the above-described IR free measurement circuit of FIG. 2A, the voltage control feedback circuit operating as a control based upon the voltage applied to the counter electrode, i.e. at line 12 in FIG. 1. By setting an appropriate value voltage control signal into this portion of the system, a form of overvoltage protection may be provided or essentially full control may be based on that voltage setting itself. The latter forms of control often are preferred in providing cathodic protection for large water tanks and the like. Similarly, current override protection may be provided by the parallel control established by the true d.c. current measurement represented generally at 86.

The voltage input is shown, as lablelled, being applied to the parallel voltage control circuit via line 300. This higher level voltage signal at line 300 is divided, for example, by 10 by the combination of resistors R46 and R47 performing with resistor R48. Line 300 then leads to the non-inverting input of a buffer-ammplifier formed of operational amplifier 302 as configured with feedback line 304 extending from output line 306. A potentiometer, P4, provides for offset voltage adjustment. Output line 306 is shown being directed to the inverting input of an operational amplifier 308 which, by interconnection with resistor R49 and capacitor C5 is configured as an integrator. Capacitor C5 is selectively reset by a multicomponent solid-state switch represented by block 310 which is shown to incorporated switching functions identified as S2–S4. Resetting of capacitor C5 is carried out by closing normally open switch S2 which, in turn, is connected by lines 312 and 314 across the capacitor. Switch S2 is closed upon the occurrence of an integrator reset (INT. RESET) signal applied through resistor R52 at line 316. It may be observed that the positive input terminal of integrator stage 308 is coupled with line 260 which extends to the emitter of transistors Q7 as shown in FIG. 2A. The latter transistor is turned on at such time as the OUTPUT DISABLE signals are not active such that the integrator stage is disabled during periods when IR free measurement is being carried out.

Returning to FIG. 2B, the output of amplifier 308 at line 318 is directed to a unity gain amplifier or buffer comprised of operational amplifier 320 operating in conjunction with resistors R50 and R53. The output of amplifier 320 at line 322 is directed through switch function S3 of solid-state switch 310. This switch S3 function is normally open and is closed with the occurrence of a "I/V SAMPLE" signal applied at line 324 through resistor R54. The closure of switch S3 provides for submittal of the integrated voltage value for any given half cycle along line 326 through current limiting resistor R55 to a storage capacitor C6. Providing a form of sample and hold function, the signal value (integrated voltage signal) retained at capacitor C6 then is directed to the input of a high input impedance buffer amplifier comprised of operational amplifier 328 operating in conjunction with a feedback line 330 extending from output line 332 to its inverting input. This output at line 332 extends through resistor R56 and C7 to a buffer comprised of operational amplifier 334 operating in conjunction with resistor R57 and a feedback line 336 extending from output line 338 to its inverting input. Line 338 is used to provide an input to a voltmeter which may be observed by the operator and optionally, to a monitoring system. Capacitor C7 provides a stability to achieve constant reading for the meter in view of the pulsed form of signal involved. The buffered output at line 332 also extends through resistor R58 to the positive terminal input of a very high gain operational amplifier 340 having a feedback 342 incorporating resistor R59 and extending from output line 344. Ths latter feedback path also includes a capacitor C8 for filtering. The negative input terminal of amplifier 340 receives a voltage "set" input or voltage control signal which is adjusted by the operator from potentiometer P5, the winding of which is connected in conjunction with resistor R60 to +15 v. The wiper arm of potentiometer P5, operating in conjunction with a filtering capacitor C9, provides the voltage control signal input to amplifier 340 through resistor R61 within line 346. Line 344 carries the output of amplifier 340 which is directed through diode D17 to the base of NPN transistor Q8. The emitter of transistor Q8 is coupled to parameter selector or control line 190, while the collector thereof is coupled via line 348 to the base of PNP transistor Q9. The emitter of transistor Q9 is coupled through resistor R62 and light emitting diode (LED) D19 to +15 v supply, while the collector of transistor Q9 is coupled to ground. With the arrangement thus shown, if the measured voltage (integrated voltage signal) is above that set by the operator at potentiometer P5, then the output at line 344 will be a logic high which serves to turn on transistor Q8 and thus, draw on transistor Q9 and illuminate or excite LED, D19. Further, the system will be controlled in conjunction with the thus measured counter electrode voltage. This voltage value is quite accurate, inasmuch as each component of voltage which is provided by the d.c. power supply 16 is integrated with each a.c. cycle crossover to achieve a true value. As before, the combination of transistor Q9 with transistor Q8 provides a form of Darlington effect. To assure accurate readout to the meter function at line 338 in view of the 33.33 millisecond disable condition, an adjustment to the output is provided by resistor R51 coupled from line 332 to ground.

Looking to the timing for operating the switching functions S2 and S3 of solid-state switch 310, reference again is made to FIG. 2C. It may be recalled that the output of amplifier 206 is pulsed in nature and occurs at 120 Hz, i.e. it represents a signal by which the commencement of any half cycle of a.c. input can be determined. This output at line 208 is directed through a diode D20 to a dual precision monostable multivibrator having two single shot devices, each with about a 20 microsecond timeout. Recall that resistor R33 provides a logic low for the digital components of this position of the system, i.e. components 244 and later described 350. Accordingly, at the commencement of each half cycle, the output of a first monostable multivibrator at terminal Q1 and line 352 assumes a logic high value and provides the signal "I/V SAMPLE". The transition of this logic signal to a low is witnessed at terminal B1 of device 350 through line 354 wherein the second monostable device commences about a 20 microsecond count out which is witnessed then as a logic high value at line 356 which is designated to carry the signal "INT. RESET". Returning to FIG. 2B, it may be observed that the signal at line 352 carrying the I/V SAMPLE signal is introduced through line 324 to effect the closure of switch S3 such that the integrated half cycle value of voltage may be admitted to sampling or storage at capacitor C6. This occurs for an interval of about 20 microseconds. Following that interval, the INT. RESET signal developed from line 356 is introduced to line 316 to effect the closure of switch S2 for 20 microseconds to provide for the resetting of the integrator stage as at 308 by shunting capacitor C5 to an initial value. Switch 310 also receives the OUTPUT DISABLE signal made available from line 256 (FIG. 2C) at line 358 through a resistor R63 and NPN transistor Q10. Accordingly, during the interval of about 33.33 microseconds wherein the d.c. power supply 16 is disabled to permit IR free measurement be carried out, transistor Q10 is forwardly biaesd into conduction and, inasmuch as its emitter is coupled with the disable terminal of solid-state switch 310 and its emitter is coupled to ground, all switching functions within solid-state switch 310 assume an open switch orientation. This is to assure that no improper voltage or current values may be developed during this period when the current to the counter electrode is discontinued.

FIG. 2B also reveals the control circuit based upon the parameter of current at the counter electrode. It may be recalled, that this current is measured by a shunt represented at block 88 in FIG. 1 and represented by resistor R89 in FIG. 3. The dual channel, positive and negative inputs of this shunt evaluation are shown in FIG. 2B as being developed at respective lines 364 and 366. Line 364 is directed through an input resistor R64 to the positive input of an operational amplifier 368 having a feedback line 370 extending from its output line 372 to its inverting input in a manner providing a buffering function. The output signals at line 372 are directed to an integration stage through a divider resistor pair comprised of resistors R67 and R68 to the positive input of an operational amplifier 374. Similarly, the negative signal at channel line 366 is directed through input resistor R69 to the positive input of a high impedance buffer comprised of operational amplifier 376 having a feedback path line 378 extending from output line 380 to its inverting input. Line 380, in turn, incorporates resistors R70 and R71 which provide a gain of 10 and function with resistors R67 and R68 to establish a difference circuit. A potentiometer P6 provides offset adjustment for the circuitry. The thus subtractively summed output at line 382 is directed to an integration stage comprised of operational amplifier 384 functioning in concert with resistor R72 and integrating capacitor C13. The positive input of operational amplifier 384 is coupled to ground through line 386, while the feedback path incorporating capacitor C13 is seen to be directed via line 390 extending from output line 392 to one side of switching function S4 of solid-stage switch 310. The other side of the switch extends via line 388 to the input of operational amplifier 384. Thus, upon the occurrence of the integrator reset signal at line 316, switch S4 is closed to reset the integrating capacitor C13 in the same manner and with the same timing aspect as provided in conjunction with capacitor C5 of the voltage parameter control described above. This will occur essentially at the commencement of each half cycle of the a.c. input at line 22 (FIG. 1).

The integrated current signal at output line 392 represents a true value of the current generated by the d.c. power supply 16. With the timing disclosed, it may be observed that integration occurrence at each half cycle provides a highly accurate current value determination. This signal at line 392 is shown being directed through input resistor R73 to the negative terminal of an operational amplifier 394, the positive terminal thereof being coupled to ground. Amplifier 394 provides an inverting gain for the signal at its output line 396, as determined by the input resistor and the feedback resistor R74 within feedback line 398. The amplified output at line 396 extends to one side of the S5 switching function of solid-state switch 310, the opposite side returning along line 400. Switch S5 is actuated identically with and simultaneously with the switching of switch function S3. Thus, the integrated current measurement is passed along line 400 for presentation to storage capacitor C14 through input resistor R76, a sample and hold form of function being developed by these components. The signal at line 400 further is directed to the positive input of an operational amplifier 402 which incorporates a feedback line 404 from its output line 406 to provide a buffering function. Line 406 is directed through divider resistors R77 and R78 to provide a correction to the output signal for the effect occasioned by the disablement of the d.c. power supply for the 33.33 millisecond IR free measurement interval. A capacitor C16 provides for noise control and the output at line 406 then is directed to the positive input terminal of a buffer comprised of operational amplifier 408, the output of which at line 412 includes a current limiting resistor R79. A feedback path is provided as line 410 extending from output line 412 to the inverting input of amplifier 408. The resultant output at line 412 may be employed to drive a current meter or for monitoring purposes.

This output at line 406 also is directed through resistor R80 and line 414 to the positive input terminal of an operational amplifier 416 which is configured to provide a very high gain. An opposite input to amplifier 416 is derived from two settings. The initial such setting is developed from a potentiometer P7, the winding of which is coupled, in conjunction with a resistor R81, to +15 v supply. This setting, which is carried out in the factory, provides an overall limit of current expressed in terms of the maximum voltage which can be used for comparison purposes. The wiper arm of potentiometer P7, in turn, is coupled to the winding of a potentiometer P8, the opposite side of which is coupled to ground through a filtering capacitor C17. Potentiometer P8 is set by the user in the field to determine the current limit of operation of the working electrode. The wiper arm of potentiometer P8 is coupled via line 420 and resistor R82 to the negative terminal of amplifier 416. A very high gain for amplifier 416 is established by resistor R82, as well as resistor R83 within feedback line 422 extending from output line 424. A high frequency bypass capacitor C18 is positioned in shunt about resistor R83. The resultant output at line 424 is directed through diode D21 to the base of NPN transistor Q11, the emitter of which is coupled to control line 190 and the collector of which is connected via line 424 to the base of PNP transistor Q12. The emitter of transistor Q12 is coupled through resistor R84 and light emitting diode D22 to +15 v, while the collector thereof is coupled to ground.

With the arrangement shown, as in the case with voltage monitoring and true d.c. current monitoring, by setting potentiometer P8, the user may arranged to have a current set function form of control on the basis of the current at the working electrode. Essentially, the voltage at the base of the controlling transistor Q1 (FIG. 2A), Q8, or Q11 (FIG. 2B) will determine which of the electrical parameters will be employed to assert control over the gating of the SCRs through transistor Q3 (FIG. 2C).

The devices of the instant invention are started upon on a relatively infrequent basis. However, during such start-up, all capacitors and the like are in an uncharged state and it is desirable that the circuit be protected from any resultant current surges and the like which otherwise might cause harm. To accommodate for this start-up condition, a "soft start" network is provided as represented in general at 430 in FIG. 2C. This soft start network includes capacitor C19 and resistor R85 within line 432. Line 432 couples one side of capacitor C19 to +15 v supply and one side of resistor R85 to −15 v supply. Line 434, carrying resistor R86 extends between the junction intermediate capacitor C19 and resistor R85 to the base of NPN Darlington transistor Q12. The collector of transistor Q12 is coupled to +15 v, while its emitter is connected via line 436 to line 190. Thus configured, at any startup, capacitor C19 will commence to decay from a charge level of +15 v over an extended time constant, for example about 10 seconds. The emitter of transistor Q12 will follow the capacitor charge level and assert the same voltage value through line 436 to line 190, thus restricting the duty cycle of the SCRs of the d.c. power supply 16 and permitting only a gradual build-up of current injection through the counter electrode.

FIG. 2C also reveals the precision d.c. power supply described at block 120 in FIG. 1 at an enhanced level of detail. It may be observed that the small step-down transformer described at block 114 and having outputs shown in FIG. 1 at line 122 and in the instant figure at lines 196 and 198 is coupled to a four diode full wave bridge 438 having a positive output at line 440 and a negative output at line 442. The latter lines are coupled with storage capacitors C20 and C21 which also extend to ground line 444. Filter capacitors C22–C25 additionally are provided in the circuit along with positive and negative 15 voltage regulators shown respectively at 446 and 448. The latter regulators may be provided, for example, respectively as type 7815 and type 7915.

Figure 3:
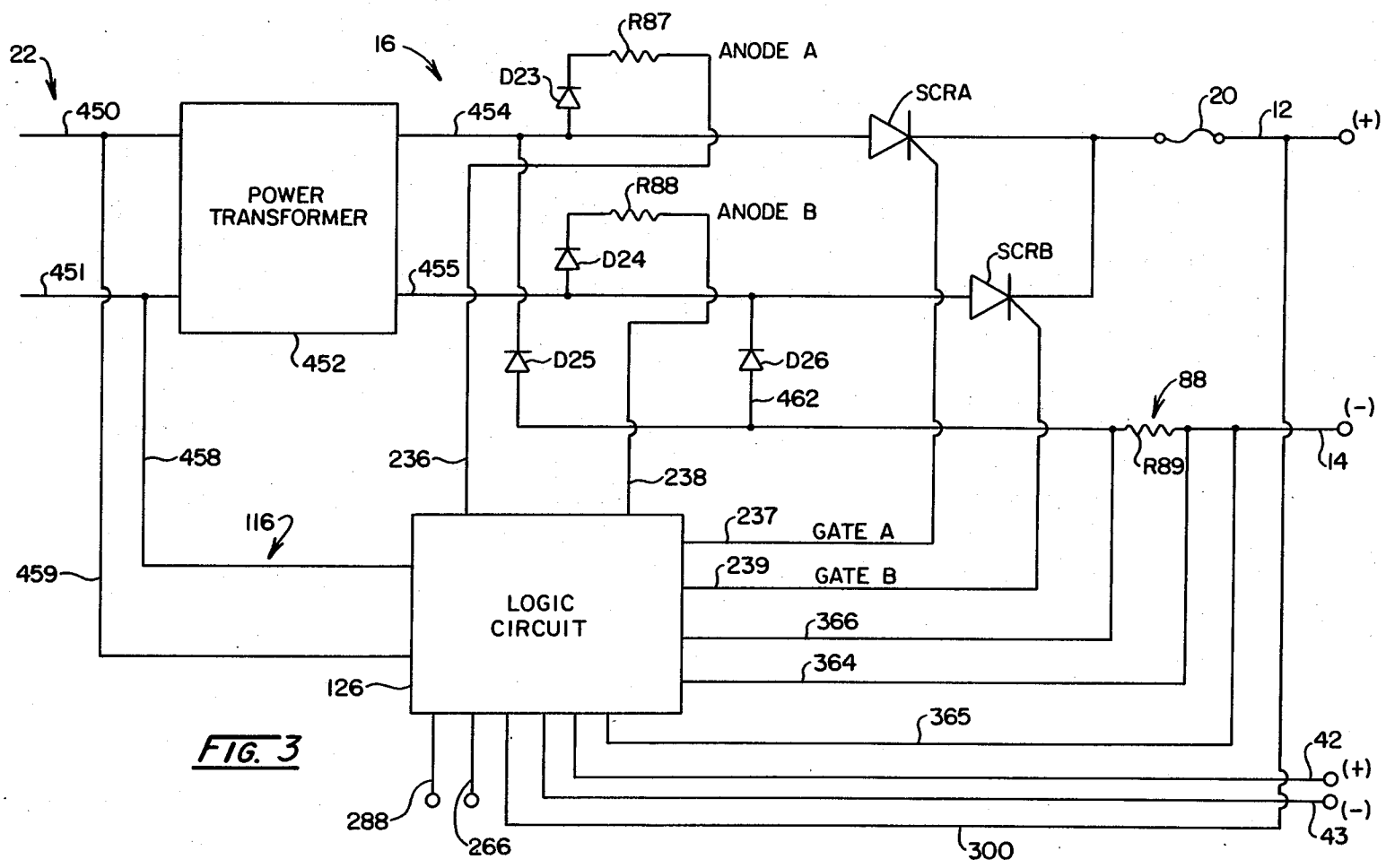
FIG. 3 is an electrical schematic diagram showing the employment of the logic circuit of FIGS. 2A–2C with the d.c. power supply of the apparatus and system of the invention.

Looking to FIG. 3, the d.c. power supply described in FIG. 1 in connection with block 16 is disclosed at a higher level of detail. In the figure, in the interest of clarity, the logic circuit representing the subject matter of FIGS. 2A–2C and enclosed by the dashed line 126 in FIG. 1 again is represented by a block having a boundary 126. Power is supplied to the system from a utility source or the like as earlier-described at 22 in FIG. 1 and now represented at lines 450 and 451. These utility input lines, having a frequency, for example of 60 Hz, are supplied to a step-down power transformer represented by block 452 which is tapped by lines 454 and 455 carrying respective silicon control rectifiers (SCRs) identified as SCRA and SCRB. Line 454 also incorporates the earlier-described fuse 20 and has been earlier described in conjunction with FIG. 1 at output line 12. Lines 237 and 239 representing respective outputs identified earlier as "gate A" and "gate B" are reproduced in FIG. 3 as deriving from the logic circuit 126 and are shown to extend to the respective gates of SCR A and SCR B. Line 14 is reproduced in the figure and represents that input to the negative or ground side of the working electrode. This line, as earlier described, carries shunt 88 for purposes of current measurement, the latter shunt being coupled to the logic circuit through earlier-described lines 364 and 366. Such shunt function is provided by a resistor R89 in the instant figure. Line 365 coupled near line 364 provides a common ground for the controller circuit. Logic circuit 126 also taps the a.c. input from lines 450 and 451, as earlier described at line 116, this input to the signal transformer being represented by lines 458 and 459. Lines 42 and 43 extending to the reference electrode again are reproduced in the drawing along with lines 288 and 266 representing, respectively, the counter reset return and sync output return are shown in the drawing. Also shown in the drawing are lines 236 and 238 which have been described in conjunction with FIG. 2C as being directed to respective terminals identified as "anode A" and "anode B". It may be observed in this regard that line 236, which extends from the earlier described terminal (labeled "ANODE A") is connected through resistor R87 and diode D23 to line 454. Similarly, line 238, which has been labelled in FIG. 2C as "anode B", extends through resistor R88 and diode D24 to line 455. Return line 14 from the working electrode is directed through shunt 88 and a power diode D25 to line 454. In this regard, diode D25 is operationally associated with SCR B. Similarly, another power diode D26, within line 462 extends to line 455 and is operationally associated with SCR A. In operation, the output at line 454 from the stepped down transformer 452, during an appropriate half cycle, serves to apply current to the anode of SCR A. At such time as a gate A signal is provided by the logic circuit 126 along line 237, the SCR is turned on to supply current to the counter electrode from line 12. This current returns via line 14, shunt 88, and diode D26 to line 455 and transformer 452. During the period of time that SCR A is on, diode D23 conducts and diode D24 functions as a block for failsafe purposes of avoiding simultaneous turn-on of the SCRs. For a next succeeding half cycle, the SCR A is commutated off and SCR B is turned on from line 455 at such time as a gating signal is received from line 239 and the logic circuit 126. As before, the return is through power diode D25 to line 454 and during the noted interval, diode D23 functions as a block to assure that SCR A is not turned on during the period of conduction of SCR B.

Since certain changes may be made in the above system, method and apparatus without departing from the scope of the invention herein involved, it is intended that all matter contained in the above description or shown in the accompanying drawings shall be interpreted as illustrative and not in a limiting sense.

I claim:

1. A system for protecting a structure associated with an electrolyte from corrosive ion transfer, having a power supply connectable with a cyclic power input and having a controllable output of fluctuating direct current and given voltage value for application to a counter electrode within said electrolyte, comprising:

current monitoring means connectable with said power suppply and having output signals responsive to said fluctuating direct current;

current integrator means for receiving and integrating said output signals to provide integrated current signals and resettable upon actuation;

first storage means for receiving said integrated current signals;

current set means adjustable to provide a selected value current control signal;

current value comparator means responsive to said integrated current signals received at said first storage means and said current control signal for deriving a current correction signal;

voltage monitoring means connectable with said power supply and having voltage signals responsive to said given voltage value thereof;

voltage integrator means for receiving and said voltage signals to provide integrated voltage signals and resettable upon actuation;

second storage means for receiving said integrated voltage signals;

voltage set means adjustable to provide a selected value voltage control signal;

voltage value comparator means responsive to said integrated voltage signals and said voltage control signal for deriving a voltage correction signal;

switching means for actuating said current integrator means and said voltage integrator means in timed correspondence with said cycle power input; and control means responsive to said current correction signal and said voltage correction signal for effecting said power supply output control in accordance with the one thereof of highest value.

2. The system of claim 1 in which said current monitoring means comprises:

shunt means including a resistor coupled with said power supply output for deriving first and second shunt voltage outputs; and difference network means responsive to said first and second shunt voltage outputs for deriving said output signals as the difference therebetween so as to remove noise phenomena.

3. The system of claim 1 in which said control means includes:

parameter control level responsive network means responsive to the level of said current correction signal and to the level of said voltage correction signal for driving a parameter control signal corresponding with said correction signal exhibiting the highest said level; and cyclic responsive control network means responsive to said parameter control signal for effecting a duty cycle control over said power supply to derive said output of fluctuating direct current.

4. The system of claim 3 including soft start network means coupled with said parameter control level responsive network means for overriding said parameter control signal for a predetermined interval upon start-up of said system so as to derive a progressively enlarging said duty cycle control over said power supply during said interval.

5. The system of claim 3 in which said current monitoring means comprises:

shunt means including a resistor coupled with said power supply output for deriving first and second shunt voltage outputs; and difference network means responsive to said first and second shunt voltage outputs for deriving said output signals as the difference therebetween so as to remove noise phenomena.

6. The system of claim 1 in which:

said current integrator means comprises a first amplifier having a feedback path extending from the input to the output thereof and including a first integrating capacitor;

said voltage integrator means comprises a second amplifier having a feedback path extending from the input to the output thereof and including a second integrating capacitor;

said switching means includes cross-over detection means responsive to said cyclic power input for deriving a half cycle signal, timing means responsive to said half cycle signal for deriving a sample signal for a predetermined sample interval and, subsequently, a reset signal for a predetermined reset interval, a first sample switch responsive to said sample signal to effect a conveyance of said integrated current signals to said first storage means, a second sample switch responsive to said sample signal to effect conveyance of said integrated voltage signals to said second storage means, a first reset switch responsive to said reset signal for resetting said first integrating capacitor and a second reset switch responsive to said reset signal for resetting said second integrating capacitor.

7. The system of claim 6 in which said current monitoring means comprises:

shunt means including a resistor coupled with said power supply output for deriving first and second shunt voltage outputs; and difference network means responsive to said first and second shunt voltage outputs for deriving said output signals as the difference therebetween so as to remove noise phenomena.

8. the system of claim 1 including clamping means coupled with said controllable output for limiting transient voltage excursions to a predetermined value.

9. The system of claim 1 including auxiliary disable means coupled with said control means responsive to an auxiliary disable signal to effect a said power supply control serving to suppress said power supply output.

10. A system for protecting a structure associated with an electrolyte from corrosive ion transfer, having a reference electrode with reference ground, a power supply connectable with a cyclic power input and a controllable output of fluctuating direct current and given voltage value for application to a counter electrode within said electrolyte, comprising:

reference monitoring means having a first channel connectable with said reference electrode and a second channel connectable with said reference ground for respectively receiving reference and ground signals therefrom;

difference network means responsive to said reference and ground signals for deriving a reference voltage signal at an output corresponding with the difference therebetween so as to effect cancellation of spurious noise phenomena;

potential set means adjustable to provide a selected value potential control signal;

potential value comparator means responsive to said potential control signal and said reference voltage signal for deriving a potential correction signal;

first switching means coupled intermediate said difference network means output and said potential value comparator means and responsive to a potential sample signal for effecting transfer of said reference voltage signal to said potential value comparator means;

control means responsive to said potential correction signal for controlling said power supply to derive said fluctuating direct current in accordance with the value thereof and responsive in the presence of a disable condition to terminate said derivation of said fluctuating direct current; and timing means for periodically deriving said disable condition for a predetermined interval selected to derive an effective said reference voltage signal and for deriving said potential sample signal for a predetermined sample interval during said disable condition.

11. The system of claim 10 including:

current monitoring means connectable with said power supply and having output signals responsive to said fluctuating direct current;

current integrator means for receiving and integratnig said output signals to provide integrated current signals and resettable upon actuation;

current set means adjustable to provide a selected value current control signal;

current value comparator means responsive to said integrated current signals and said current control signal for deriving a current correction signal;

second switching means responsive to a sample signal for effecting conveyance of said output signals to said current integrator means and to a reset signal for resetting said current integrator means;

said control means is responsive to said current correction signal and said potential correction signal to derive said fluctuating direct current in accordance with the one thereof of highest value; and said timing means derives said sample signal and said reset signal in timed correspondence with said cyclic power input.

12. The system of claim 11 in which said current monitoring means comprises:

shunt means including a resistor coupled with said power supply output for deriving first and second shunt voltage outputs; and difference network means responsive to said first and second shunt voltage outputs for deriving said output signals as the difference therebetween so as to remove noise phenomena.

13. The system of claim 10 in which said control means includes:

parameter control level responsive network means responsive to the level of said current correction signal and to the level of said potential correction signal for deriving a parameter control signal corresponding with said correction signal exhibiting the higher said level; and cyclic responsive control network means responsive to said parameter control signal for effecting a duty cycle control over said power supply to derive said output of fluctuating direct current.

14. The system of claim 13 including soft start network means coupled with said parameter control level responsive network means for overriding said parameter control signal for a predetermined interval upon start-up of said system so as to derive a progressively enlarging said duty cycle control over said power supply during said interval.

15. The system of claim 10 including:

voltage monitoring means connectable with said power supply and having voltage signals responsive to said given voltage value thereof;

voltage intergrator means for receiving and said voltage signals to provide integrated voltage signals and resettable upon actuation;

voltage set means adjustable to provide a selected value voltage control signal;

voltage value comparator means responsive to said integrated voltage signals and said voltage control signal for deriving a voltage correction signal;

third switching means responsive to a sample signal for effecting conveyance of said voltage signals to said voltage integrator means and to a reset signal for resetting said voltage integrator means;

said control means is responsive to said voltage correction signal and said potential correction signal to derive said fluctuating direct current in accordance with the one thereof of highest value; and said timing means derives said sample signal and said reset signal in timed correspondence with said cyclic power input.

16. The system of claim 15 in which said control means includes:

parameter control level responsive network means responsive to the level of said potential correction signal and to the level of said voltage correction signal for deriving a parameter control signal corresponding with said correction signal exhibiting the highest said level; and cyclic responsive control network means responsive to said parameter control signal for effecting a duty cycle control over said power supply to derive said output of fluctuating direct current.

17. The system of claim 16 including soft start network means coupled with said parameter control level respnsive network means for overriding said parameter control signal for a predetermined interval upon start-up of said system so as to derive a progressively enlarging said duty cycle control over said power supply during said interval.

18. The system of claim 15 including:

current monitoring means connectable with said power supply and having output signals responsive to said fluctuating direct current;

current integrator means for receiving and integrating said output signals to provide integrated current signals and resettable upon actuation;

current set means adjustable to provide a selected value current control signal;

current value comparator means responsive to said integrated current signals and said current control signal for deriving a current correction signal;

second switching means responsive to said sample signal for effecting conveyance of said output signals to said current integrator means and to said reset signal for resetting said current integrator means; and said control means is responsive to said current correction signal, said voltage correction signal and said potential correction signal to derive said fluctuating direct current in accordance with the one thereof of highest value.

19. The system of claim 18 in which said current monitoring means comprises:

shunt means including a resistor coupled with said power supply output for deriving first and second shunt voltage outputs; and difference network means responsive to said first and second shunt voltage outputs for deriving said output signals as the difference therebetween so as to remove noise phenomena.

20. The system of claim 18 in which said control means includes:

parameter control level responsive network means responsive to the level of said current correction signal, said potential correction signal and to the level of said voltage correction signal for deriving a parameter control signal corresponding with said correction signal exhibiting the higher said level; and cyclic responsive control network means responsive to said parameter control signal for effecting a duty cycle control over said power supply to derive said output of fluctuating direct current.

21. The system of claim 20 including soft start network means coupled with said parameter cotrol level responsive network means for overring said paraemeter control signal for a predetermined interval upon start-up of said system so as to derive a progressively enlarging said duty cycle control over said power supply during said interval.

22. The system of claim 18 in which:

said current integrator means comprises a first amplifier having a feedback path extending from the input to the output thereof and including a first integrating capacitor;

said voltage integrator means comprises a second amplifier having a feedback path extending from the input to the output thereof and including a second integrating capacitor;

said timing means includes cross-over detection means responsive to said cyclic power input for deriving a half cycle signal, timing means responsive to said half cycle signal for deriving said sample signal for a predetermined sample interval and, subsequently, said reset signal for a predetermined reset interval;

said second switching means comprises a first sample switch responsive to said sample signal to effect a conveyance of said integrated current signals to said current value comparator and a first reset switch responsive to said reset signal for resetting said first integrating capacitor;

said third switching means comprises a second sample switch responsive to said sample signal to effect conveyance of said integrated voltage signals to said voltage value comparator means and a second reset switch responsive to said reset signal for resetting said second integrating capacitor.

23. The system of claim 10 including first clamping means coupled with said reference means first and second channels for limiting transient voltage excursions to a predetermined value.

24. The system of claim 23 including clamping means coupled with said controlable output for limiting transient voltage excursions to a predetermined value.

25. The system of claim 10 including auxiliary disable means coupled with said control means responsive to an auxiliary disable signal to effect a said power supply control serving to suppress said power supply output.

26. A method for controlling the application from a power supply output of cyclic but fluctuatnig pulses of direct current at a counter electrode having a positive lead extending thereto and at a structure immersed in an electrolyte having a ground lead extending thereto, for retarding corrosion of the structure, comprising:

sensing said direct current through first and second signal carrying channels extending from opposite sides of a current monitor associated with one said lead;

cancelling spurious noise phenomena with said first and second channels by electrically deriving the difference between the signals therein to derive output signals;

integrating said output signals in timed correspondence with each cyclic appearance of said supply output pulses to provide integrated current signals;

comparing the value of said integrated current signals with a first predetermined set value to derive a current correction signal;

sensing the voltage of said power supply output to derive voltage signals;

integrating said voltage signals in timed correspondence with each cyclic appearance of said power supply output pulses to provide integrated voltage signals;

comparing the value of said integrated voltage signals with a second predetermined set value to derive a voltage correction signal; and controlling the current level of said power supply output in correspondence with the said correction signal of largest value.

27. The method of claim 26 including the steps of:

providing reference electrode means for deriving reference ground and reference potential signals;

cancelling spurious noise phenomena from said reference ground and reference potential signals by electrically deriving the difference therebetween to provide reference voltage signals;

disabling said power supply output periodically for a predetermined IR drop free interval;

sample said reference voltage signals during a predetermined period within said IR drop free interval; and comparing the value of said sampled reference voltage signals with a third predetermined set value to derive a potential correction signal.

* * * * *